United States Patent [19]

McLellan

[11] Patent Number: 5,038,855

[45] Date of Patent: Aug. 13, 1991

[54] HEAT EXCHANGER WITH INTERNAL STIRRER

[76] Inventor: Edward J. McLellan, 422 Connie Ave., Los Alamos, N. Mex. 87544

[21] Appl. No.: 339,989

[22] Filed: Apr. 17, 1989

[51] Int. Cl.[5] ..... F28F 13/12

[52] U.S. Cl. ..... 165/109.1; 165/94; 366/149; 366/303

[58] Field of Search ..... 165/109.1, 120–122, 165/94; 415/90, 199.4, 199.5; 366/149, 303

[56] References Cited

U.S. PATENT DOCUMENTS

| | | | |
|---|---|---|---|
| 1,375,210 | 4/1921 | Clayton et al. | 165/94 |
| 1,977,955 | 10/1934 | Robinson | 366/303 X |
| 2,388,003 | 10/1945 | McCullough | 165/109.1 X |
| 2,628,077 | 2/1953 | Handwerk | 165/109.1 X |
| 2,630,302 | 3/1953 | Jones | 165/109.1 X |
| 2,992,182 | 7/1961 | Elzinga et al. | 165/109.1 X |
| 3,031,273 | 4/1962 | Latinen | 165/94 X |
| 3,187,802 | 6/1965 | Hickey | 165/2 |
| 4,330,215 | 5/1982 | Gale | 366/99 |
| 4,558,733 | 12/1985 | Lindroos | 165/94 |
| 4,645,418 | 2/1987 | Siegel | 415/199.5 |

FOREIGN PATENT DOCUMENTS 2083687A 3/1982 United Kingdom .

*Primary Examiner*—Martin P. Schwadron
*Assistant Examiner*—Allen J. Flanigan
*Attorney, Agent, or Firm*—Samuel M. Freund

[57] ABSTRACT

A positive displacement apparatus for efficiently exchanging heat between a fluid and a heat exchanger. A moving comb-shaped blade is used to stir the fluid through a heat exchanger having fins located internally thereto adapted to receive the blade and to intermesh with the tines which are part of the blade in such a manner that the blade can pass through the heat exchanger while the amount of fluid backflow behind the blade in the direction opposite to the direction of movement thereof is kept low when compared to that driven by the blade. The blade simultaneously pulls the fluid behind it through the heat exchanger. The efficiency of the apparatus is related to the amount of fluid leaking past the blade while it is traversing the heat exchanger.

5 Claims, 7 Drawing Sheets

HEAT EXCHANGER WITH INTERNAL STIRRER

BACKGROUND OF THE INVENTION

The present invention relates generally to heat exchange between a fluid and a heat exchanger, and more particularly to an apparatus for more efficiently exchanging heat between a fluid and a heat exchanger using a comb-like driver which passes through the heat exchanger.

Heat exchange between fluids and a device for adding or removing heat therefrom is a pervasive problem in the industrial and scientific environment. For example, it is necessary to remove heat from lasing gases to permit high repetition rates for firing, and heat must be removed from oils required to lubricate internal combustion engines, to name but two application areas. Generally, gases are directed into contact with a large area surface to which heat can be exchanged and which in turn is heated or cooled as appropriate. Apparatus for moving the gas often includes a blower such as a fan or a Roots blower, and an enclosed recirculation path external to the active region of the gas. Such apparatus is often bulky, inefficient, and costly, since the heat exchange surface is usually enclosed and finned, thereby presenting a significant pressure impediment to the flow of gas; that is, a large pressure drop may be experienced by the gas in flowing through the heat exchanger. An example of a circulating gas laser apparatus is illustrated in "Circulating Gas Laser," by Donald Sutherland Stark and Peter Harold Cross, UK Patent Application No. 1 GB 2083687, filed on Aug.17, 1981, which shows a cooling system for laser gases which significantly increases the size of the laser apparatus.

Accordingly, it is an object of the present invention to provide a compact, efficient apparatus for adding or removing heat from a fluid.

Another object of the present invention is to provide a compact, efficient, in-line apparatus for adding or removing heat from a fluid which presents a minimum pressure impediment to the fluid flow.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the apparatus for efficiently exchanging heat between a fluid and a heat exchanger of this invention includes comb-shaped fluid stirring means comprising a planar, elongated support member having a plurality of tines disposed perpendicular to the long dimension of the support member and lying in the plane thereof, a heat exchanger for exchanging heat with the fluid having a slot within the body thereof for permitting the support member to pass therethrough, and further having fins disposed perpendicular to the slot adapted to receive the tines such that the clearance between the fins and the tines and that between the support member and the heat exchanger provides sufficient space to permit the passage of the fluid stirring means through the heat exchanger while maintaining a low fluid flow passing behind the fluid driving means opposite to the direction of movement thereof as the tines are moved through the heat exchanger, and means for moving the fluid stirring means through the heat exchanger.

In a further aspect of the present invention, in accordance with its objects and purposes, the apparatus for efficiently exchanging heat between a fluid and a heat exchanger hereof includes comb-shaped fluid stirring means comprising a planar, elongated support member having a plurality of tines disposed perpendicular to the long dimension of the support member and lying substantially in the plane thereof, a heat exchanger for exchanging heat with the fluid having one side which is substantially adapted to conform to the path of motion of the support member with fins disposed perpendicular to this side adapted to receive the tines, such that the clearance between the fins and the tines provides sufficient space to permit the passage of the tines through the fins, while maintaining a low fluid flow passing behind the tines opposite to the direction of movement thereof, a baffle disposed perpendiculary to the adapted side of the heat exchanger and spaced-apart therefrom for reducing the fluid flow passing behind the support means in a direction opposite to the direction of movement thereof, and means for moving the tines of the fluid stirring means through the heat exchanger.

Benefits and advantages of the apparatus of the present invention include compact design, high efficiency over a broad range of pressures in the situation where gases are to be cooled in the heat exchanger, and the elimination of external return ducting.

BRIEF DESCRIPTION OF THE DRAWINGS

The accompanying drawings, which are incorporated in and form a part of the specification, illustrate three embodiments of the present invention and, together with the description, serve to explain the principles of the invention. In the drawings:

FIG. 1*a* is a schematic representation of an end view of the apparatus for propelling a fluid through a heat exchanger of the subject invention used in an in-line oil heat exchange apparatus, while

DETAILED DESCRIPTION OF THE INVENTION

Briefly, the subject invention in its broadest form is a positive displacement apparatus for propelling a fluid through a heat exchanger. A moving comb-shaped blade is used to drive the fluid through a heat exchanger having fins located internally thereto adapted to receive the blade and to intermesh with the tines which are part of the blade in such a manner that the blade can pass through the heat exchanger while the amount of fluid backflow behind the blade in the direction opposite to the direction of movement thereof is kept low when compared to that driven by the blade. The blade simultaneously pulls the fluid behind it through the heat exchanger. The efficiency of the apparatus is related to the amount of fluid leaking past the blade while it is traversing the heat exchanger.

Figure 1A:
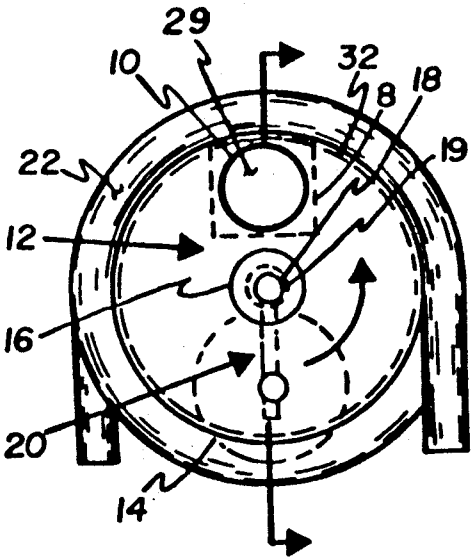
Figure 1B:
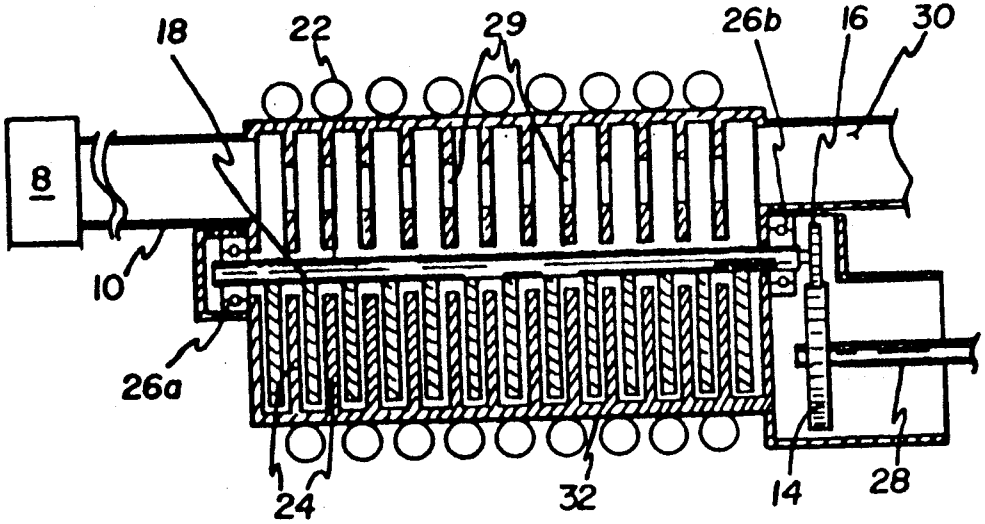
FIG. 1*b* is a schematic representation of a side view thereof. In this embodiment, the oil flows essentially unimpeded through an aperture made in the heat exchanger fins.

Reference will now be made in detail to the present preferred embodiments of the invention, example of which are illustrated in the accompanying drawings. Similar or identical structure is identified using identically numbered call outs. FIGS. 1*a* and 1*b* are a schematic representation of the apparatus of the present invention utilized in an in-line oil cooling application. FIG. 1*a* is an end view of the apparatus. As shown, oil pressurization means 8 drives heated oil into oil inlet 10 and permits this oil to enter a heat exchanger 12 composed of a plurality of parallel fins. Gears 14 and 16 cause an elongated support member or shaft 18 to rotate. An elongated slot 19 formed in the fins is adapted to receive this shaft. A plurality of tines 20 are disposed generally perpendicular to shaft 18 and are attached thereto. Cooling coils 22 remove heat from heat exchanger 12. Tines 20 intermesh with the parallel fins 24 of heat exchanger 12 as is illustrated in FIG. 1*b*. Preferably, the tines have a rectangular cross section, and are dimensioned such that shaft 18 can move the tines through the heat exchanger without binding in the fins, while little oil leaks behind the tines in the direction opposite to their movement. It is also preferred that shaft 18, which is supported by bearings 26*a* and 26*b*, be fitted such that little oil leaks along its surface. Drive shaft 28 provides torque to gear 14 from an external source of rotary power. All of the fins have an orifice 29 present therein which permits the oil to have a low-resistance path through the plurality of fins in the heat exchanger to exit port 30. As the tines rotate through the heat exchanger, oil is stirred into the heat exchanger and cooled thereby. Emerging oil reenters the path and exits through port 30. Construction of the apparatus might be achieved by bolting or welding two half-cylindrical configurations of parallel fins together after the shaft and tines are installed therein. Fins 24 are attached to a common base 32 which forms the walls of the heat exchanger 12 and the surface of the cylinder formed by the fins, creating thereby an enclosure for the oil.

Figure 2A:
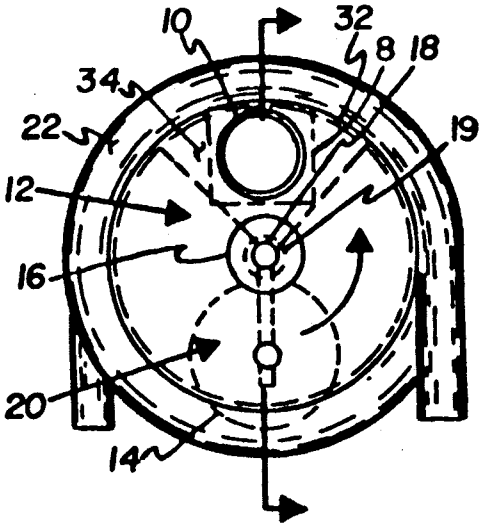
FIG. 2*a* is a schematic representation of an end view of the apparatus for stirring a fluid through a heat exchanger of the subject invention also used in a similar in-line oil heat exchange application to that described in FIG. 1*a,b* hereof.
Figure 2B:
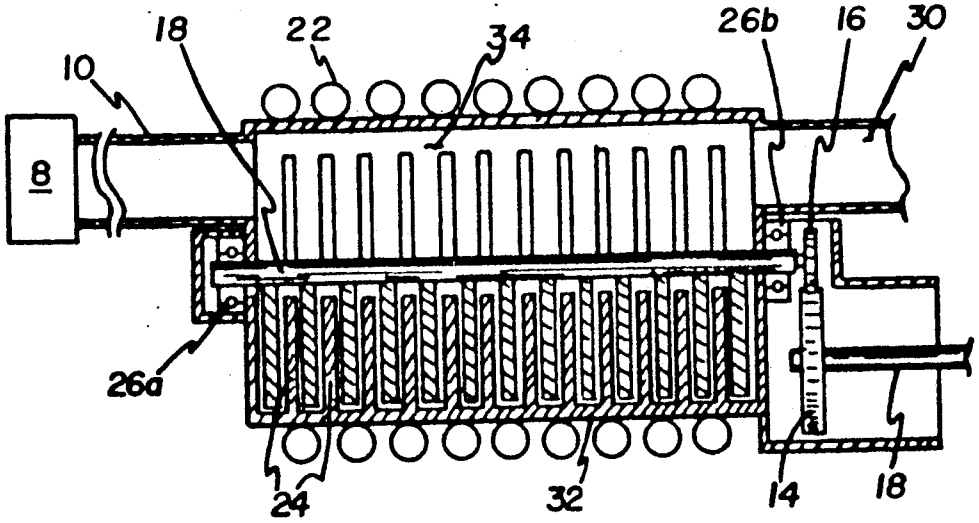
FIG. 2*b* is a schematic representation of a side view thereof. Shown is an embodiment where the oil flows substantially unimpeded through a volume outside of the heat exchanger.

FIGS. 2*a* and 2*b* are a schematic representation of the apparatus of the present invention utilized in the identical application illustrated in FIGS. 1*a* and 1*b* hereof, except that the parallel fins are no longer fully cylindrical. That is, a V-shaped volume 34 is formed in the fins of the heat exchanger in order to provide the oil a low-resistance pathway between the entrance and exit ports. Clearly, in the embodiments illustrated in FIGS. 1 and 2 hereof, additional sets of tines could be added to the support member to improve the smoothness of the return of oil to the in-line flow.

Another application of the apparatus of the present invention is the movement of gases through a heat exchanger for cooling such gases for high power lasers. Before illustrating a specific embodiment, it is necessary to briefly discuss the relationship among the various component parts. The textbook, *Compact Heat Exchangers*, by W. M. Kays and A. L. London (McGraw-Hill Book Company, 1985) was utilized extensively in the detailed analysis of the apparatus of the present invention as applied to the propulsion of a gas through a heat exchanger. The analysis proceeds by analyzing the slot formed by each pair of fins in the heat exchanger, and similarly by analyzing the reduced slot formed when a tine is present in this slot; that is, the clearance space between the tine and the heat exchanger, for low-density gases such as those used in low-pressure gas lasers having high helium content. Such gases have a low enough Reynolds number that laminar flow can be assumed.

If the pressure drop created by moving a gas through a given slot is assumed to be equal to the pressure drop across the reduced slot, the relevant equations may be approximately solved to give the efficiency of the apparatus for stirring the gases. Efficiency is here defined as the ratio of the volume of gas which passes through the heat exchanger slots to this volume plus the volume of gas passing around the tines. Additional pressure drop in the heat exchanger occurs as a result of entrance and exit effects which are described in the Kays and London reference. Experiments show that these effects are important for long, narrow slots such as those created by the clearance between the tines and the fins of the heat exchanger. Analysis indicates further that the efficiency determined ignoring the entrance and exit effects represents the minimum efficiency. It turns out that for all dimensions contemplated for the comb-shaped blade and the heat exchanger, and for all rotation speeds and gas pressures theoretically investigated as giving rise to a practicable laser design, that the calculated efficiency can be made quite high.

Turning now to a laser gas cooling application of the apparatus of my invention, a major advantage of using such a cooling system is the compact laser system which results. The apparatus is useful for all relevant gas pressures and types, while the more usual blower systems and fans lose their effectiveness for low gas densities. In addition, a fan or blower assembly requires that the rotating gas driving apparatus be enclosed in a separate housing with appropriate ducting to propel the gas through the heat exchanger and return it to the laser discharge region, after passing the gas through a flow straighten duct. The present apparatus permits the gas stirring device, the heat exchanger, the laser discharge region, and the entrance and exit duct regions to occupy overlapping volumes. Therefore, a significant reduction in size for high power lasers can be achieved.

Figure 3A:
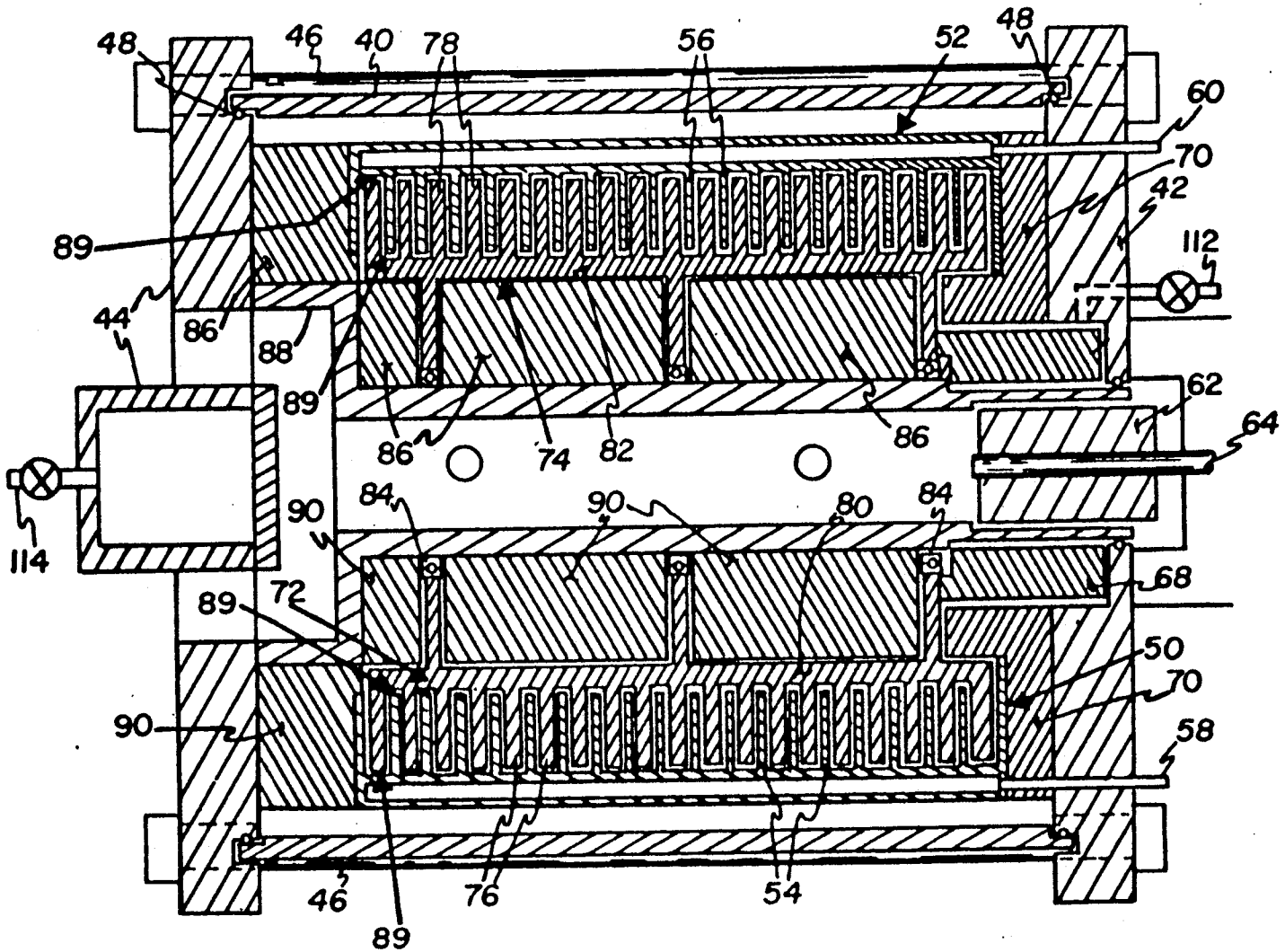
FIGS. 3*a–e* are a schematic representation of a third embodiment of the apparatus of the present invention utilized for cooling laser gases in a pulsed, transverse-excitation laser.

FIG. 3*a* is a schematic representation of a side view of a laser apparatus wherein the lasing gas is cooled according to the teachings of the present invention. A bounded volume is formed by cylindrical outer tube 40 and flanges 42 and 44. The flanges and tube 40 are held together using support rods 46. O-rings 48 provide a substantially gas-tight seal. Heat exchanger 50, 52 having fins 54, 56 is cooled by circulating water therethrough by means of water inlet tube 58 and water exit tube 60. Internal connection to permit the necessary flowthrough has not been shown in order to reduce the complexity of the Figure. A magnet 62 turned by shaft 64 responsive to an external source of rotary motion, is coupled to magnet 68, interior to the bounded volume. Comb-shaped gas stirring structure or blades 72, 74 including tines 76, 78, and movable first and second support members 80, 82, respectively, is rotatably mounted on bearings 84. Support members 80, 82 are fixedly attached to rotating magnet 68. The gas stirring structure, then, is caused to rotate about center tube 88 by the rotation of magnet 62. The tines intermesh with the fins of the heat exchanger. The surface 89 of each heat exchanger facing the blade is concave in shape to closely accommodate the passage of the mounting bars in order that the gas flow behind the blades in a direction opposite to the direction of travel thereof is kept small when compared with the quantity of gas pushed forward by the blade. Preferably, the tines have rectangular cross section, and the relative dimensions of the fins, and the tines are chosen according to the principles of the discussion set forth hereinabove. In this embodiment of my invention, baffles 86, 90 are rigidly attached to center tube 88 and baffles 70 are rigidly attached to end plate 42 in order to reduce the flow of gas in the opposite direction to the movement of the gas movement structure, since this structure rotates alongside of the heat exchanger, rather than interior thereto.

Figure 3B:
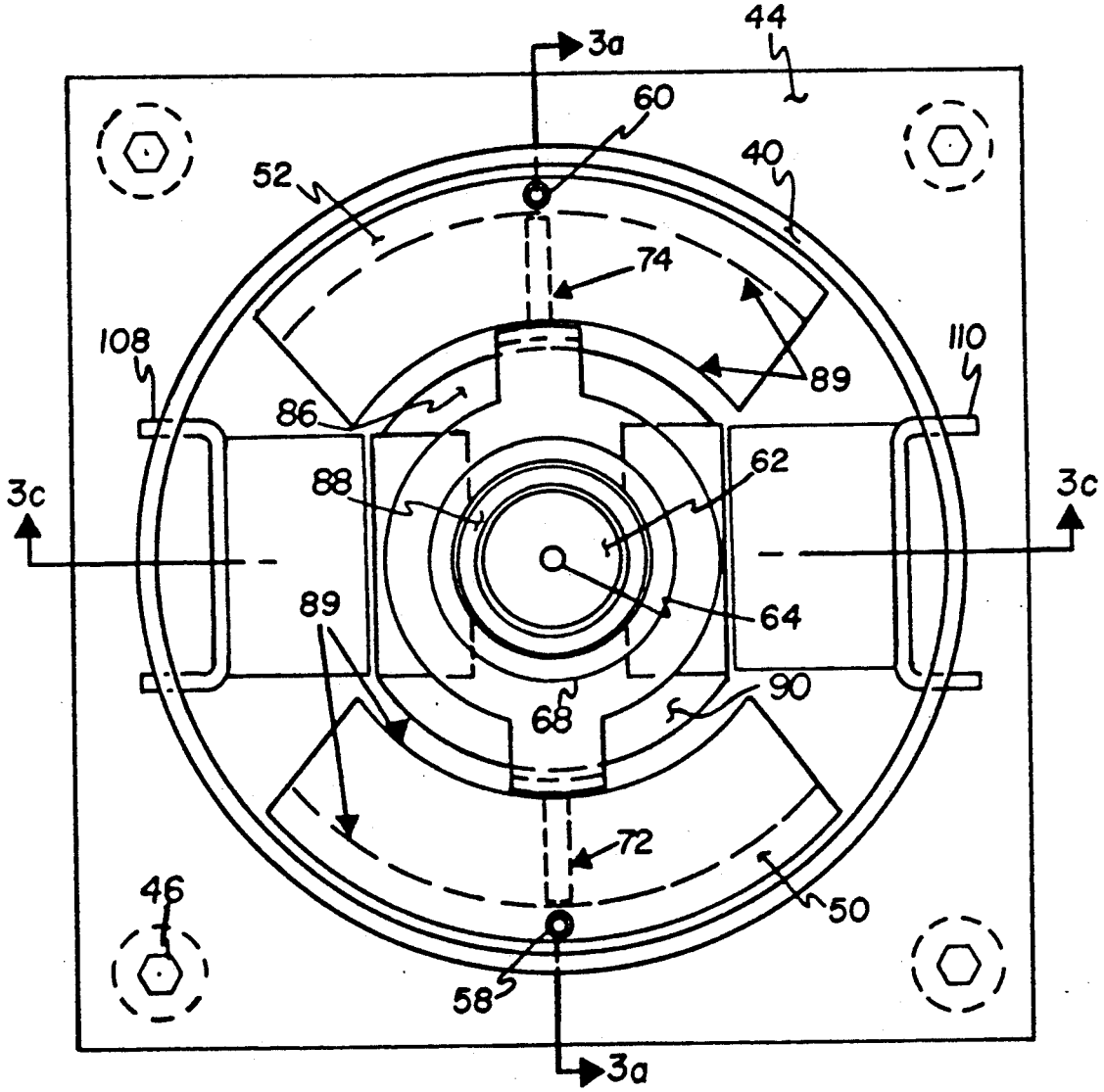

FIG. 3*b* is an end view of the lasing apparatus as would be observed looking toward flange 42 from the outside with the flange removed.

Figure 3C:
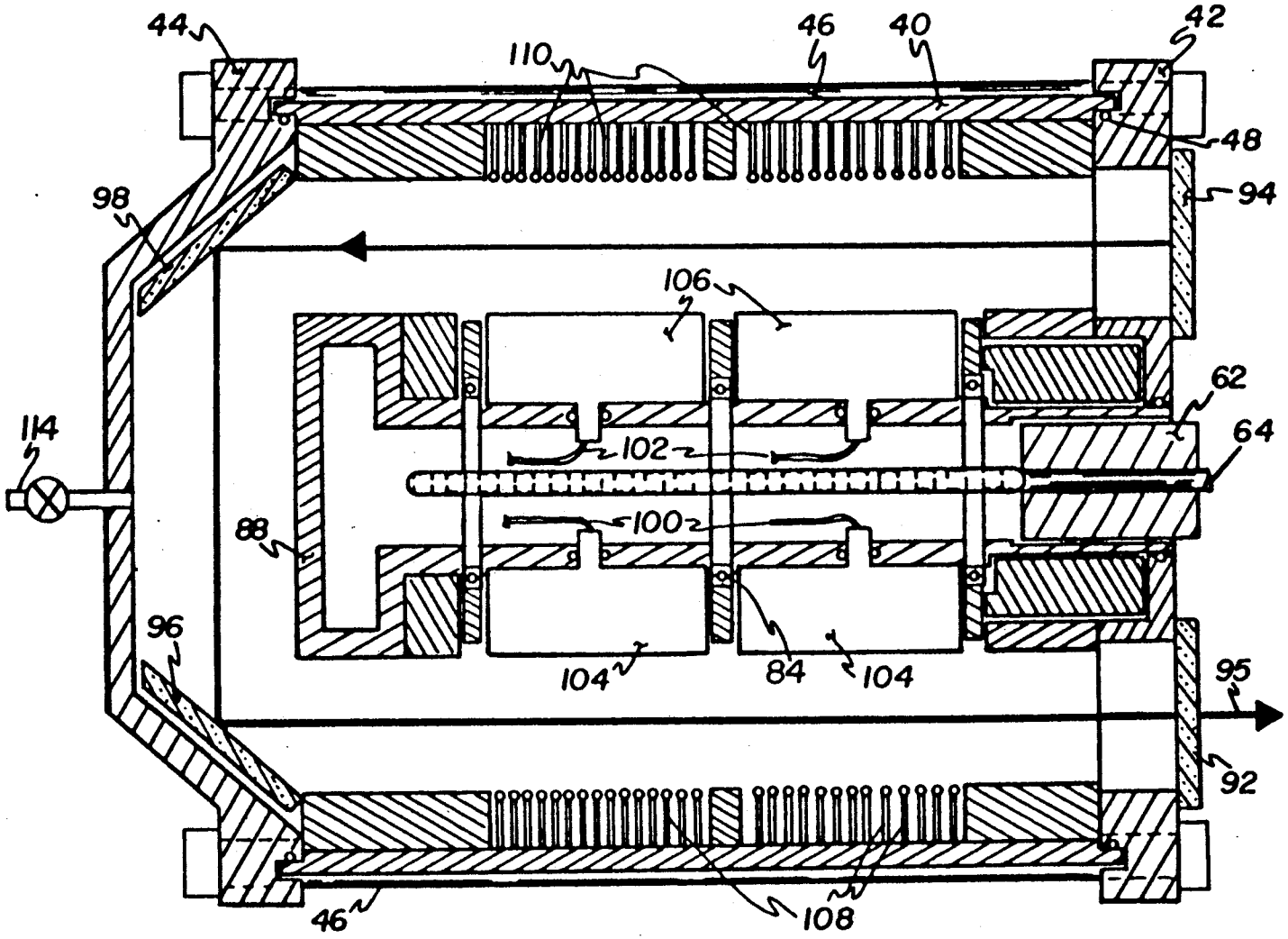

FIG. 3*c* is a schematic representation of the side view of the laser apparatus perpendicular to that illustrated in FIG. 3*a* hereof. Therein is shown windows 92, 94. In a specific example, window 94 could be totally reflecting, and laser output 95 would emerge from window 92 if it was made partially light transmitting. Mirrors 96, 98 complete the folded optical cavity. Electrical cables 100, 102 provide electrical energy to gas ionizer/-grounded anode structures 104, 106, and exit through flange 44. Cathode structure 108, 110 complete the laser electrode structure. Lasing gas may be admitted and replaced through gas inlet/outlet fitting 112, and 114 mounted on the flanges. A four blade rotating comb-like gas stirrer is envisioned in cooperation with two heat exchangers. The blades would be symmetrically positioned 90 degrees apart. A greater number of blades in cooperation with a greater number of heat exchangers is also possible.

Figure 3D:
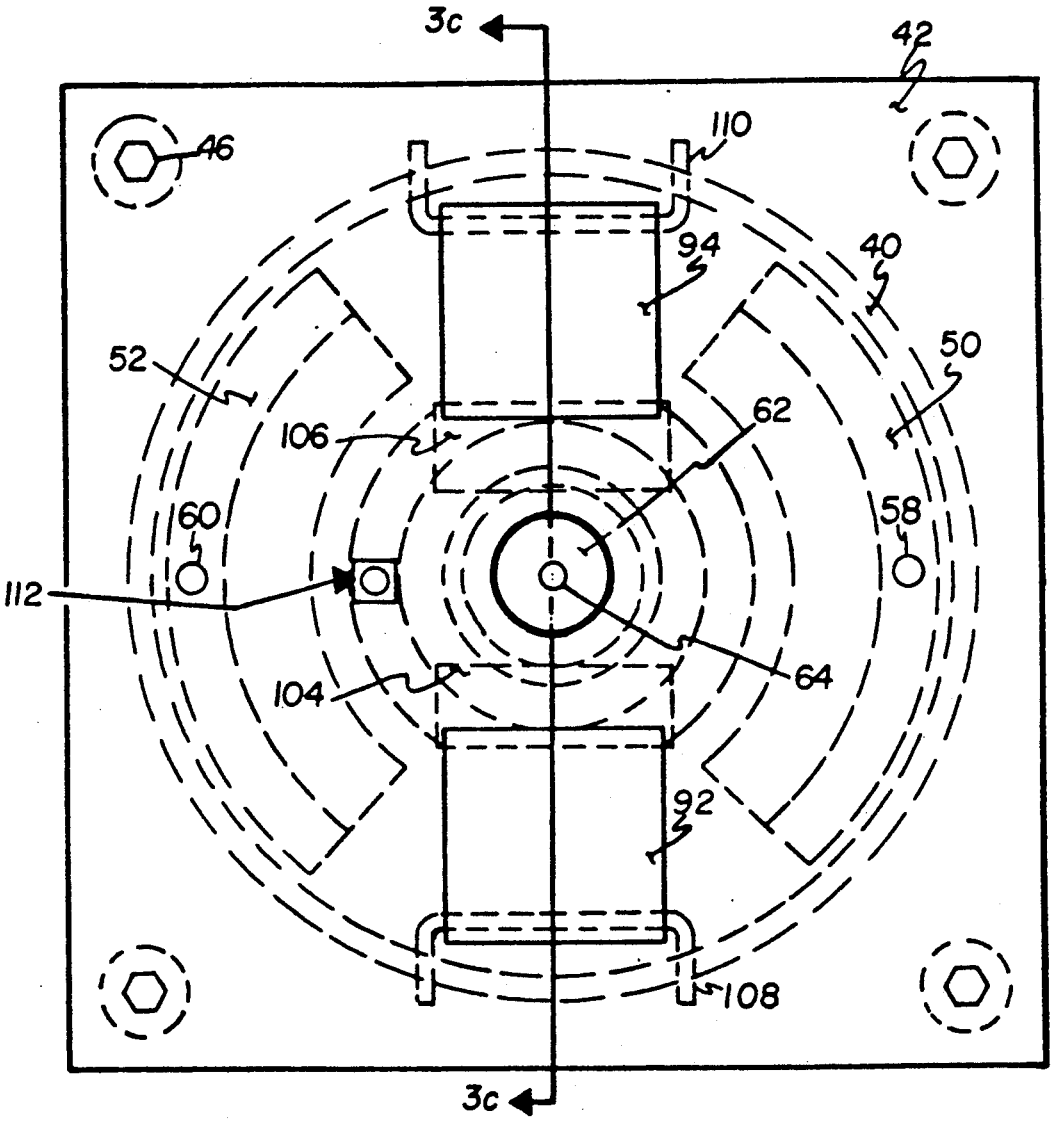
Figure 3E:
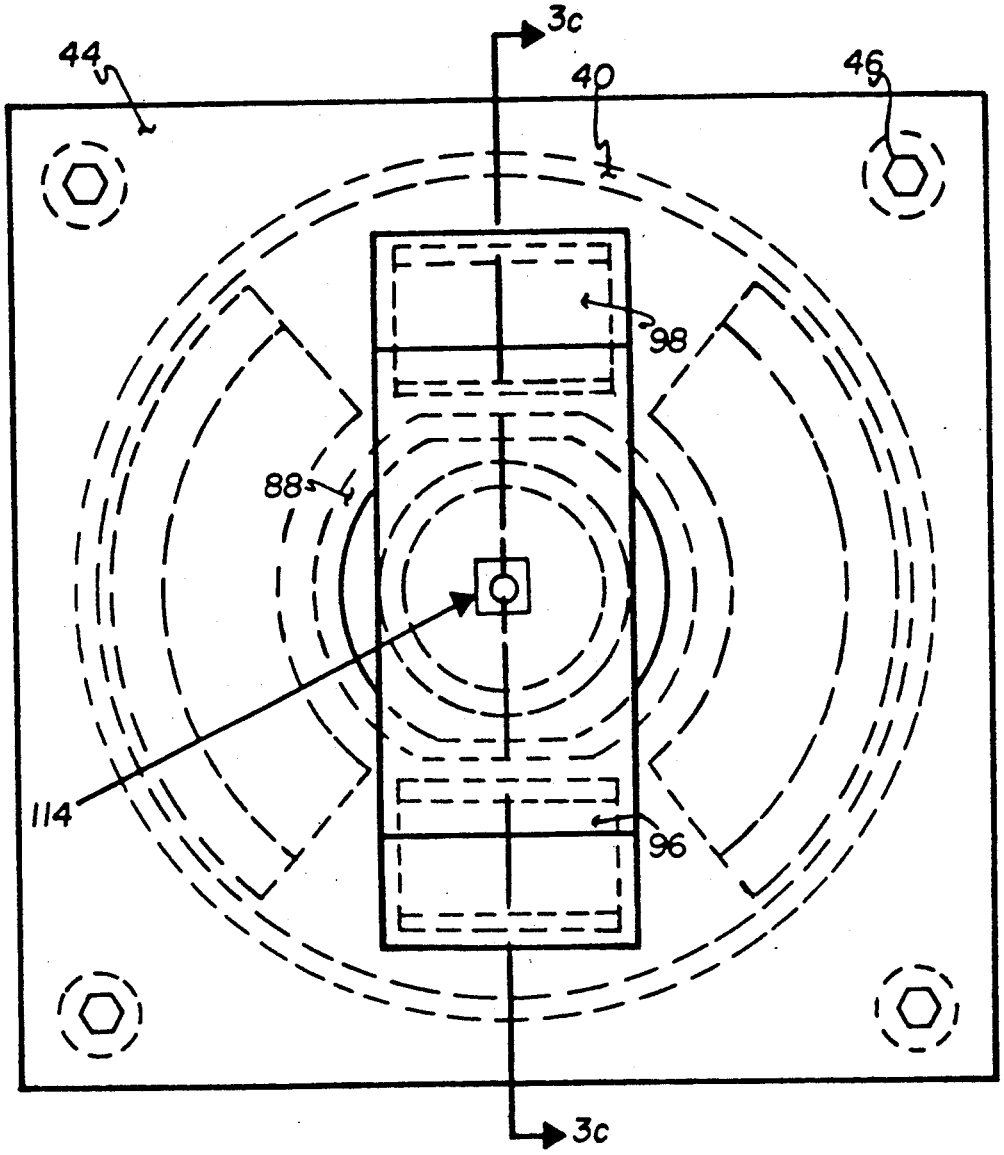

FIGS. 3*d* and 3*e* are end views of the apparatus illustrated in FIG. 3*c* hereof as would be seen by looking from flange 42 and 44, respectively.

The laser must be fired when the blades are sufficiently far out of the discharge regions to prevent arcing of the laser discharge to the blades. For the four blade system, for example, the laser can be fired four times for each rotation of the comb structure. The maximum rotating speed of the comb is limited by the strength of the comb with respect to disintegration due to centrifugal forces and by the clearance to the heat exchanger decreasing as a result of these forces, thereby permitting the comb to destructively contact the heat exchanger. Vibrations may also cause contact. Allowance must be made for these effects in the choice of clearances. There is a practical limit on the rotation speed, however. This is related to the dwell time of the gas in the heat exchanger. At sufficiently high rotational speed, the gas may not cool sufficiently. Other restrictions on the clearance between the tines and the fins include thermal expansion and contraction. To minimize these problems, the comb structure may be built in segments. A single segment apparatus is shown in FIGS. 3*a* and 3*c* hereof. However, any number of segments may be employed to provide a chosen length.

The foregoing description of three preferred embodiments of the invention has been presented for purposes of illustration and description. It is not intended to be exhaustive or to limit the invention to the precise form disclosed, and obviously many modifications and variations are possible in light of the above teaching. For example, it would be apparent to one having ordinary skill in the art of heat exchange in fluids, after studying the subject disclosure, that the present invention can be utilized to add heat to a fluid as well as to cool the fluid as described hereinabove. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for efficiently exchanging heat between a fluid and a heat exchanger, which comprises in combination:

a. fluid stirring means for stirring the fluid in the direction of motion thereof comprising an elongated support member having a plurality of tines each having a chosen width and extent and disposed in a substantially perpendicular manner to the long dimension of said support member and lying substantially in the flat plane thereof;

b. heat exchanger means for exchanging heat with the fluid, said heat exchanger means having an elongated slot within the body thereof within which said support member is disposed, and further having fins disposed substantially perpendicular to the slot adapted to receive the tines, said fins having an extent in the direction of motion of said tines which is at least twice that of the tines, wherein the clearance between the fins and the tines is small relative to the width of the tines and is consistently maintained along substantially the full extent of the tines and wherein the clearance between the fins and the tines and between said support member and said heat exchanger means provides sufficient space to permit the passage of said fluid stirring means through said heat exchanger means, while maintaining low fluid flow passing behind said fluid stirring means opposite to the direction of movement thereof as the tines are moved through said heat exchanger;

c. means for moving said fluid stirring means through said heat exchanger; and d. means for moving the fluid through the apparatus.

2. An apparatus for efficiently exchanging heat between a fluid and a heat exchanger, which comprises in combination:

a. fluid stirring means for stirring the fluid in the direction of motion thereof comprising an elongated support member having a plurality of tines disposed in a substantially perpendicular manner to the long dimension of said support member and lying substantially in the flat plane thereof;

b. heat exchanger means for exchanging heat with the fluid, said heat exchanger having a substantially flat side with fins disposed substantially perpendicular to the flat side adapted to receive the tines, said fins having an extent in the direction of motion of said tines which is at least twice that of the tines, wherein the clearance between the fins and the tines provides sufficient space to permit the passage of the tines through the fins, while maintaining low fluid flow passing behind the tines opposite to the direction of movement thereof;

c. baffle means disposed substantially perpendicular to the flat side of said heat exchanger means and spaced-apart therefrom for reducing the fluid flow passing behind said support means in a direction opposite to the direction of movement thereof;

d. means for moving the tines of said fluid stirring means through said heat exchanger; and e. means for moving the fluid through the apparatus.

3. An in-line fluid cooling apparatus, which comprises in combination:

a. fluid stirring means for stirring the fluid in the direction of motion thereof comprising an elongated support member having a plurality of tines disposed in a substantially perpendicular manner to the long dimension of said support member and lying substantially in the flat plane thereof;

b. generally cylindrical heat exchanger means for exchanging heat with the fluid, said heat exchanger means having an elongated slot within the body thereof disposed along the axis thereof in which is disposed said support member and for permitting said support member to rotate therein, and further having fins disposed substantially radially and perpendicular to the slot and adapted to receive the tines, said fins having an extend in the direction of motion of said tines which is at least twice that of the tines, wherein the clearance between the fins and the tines provides sufficient space to permit the passage of the tines of said fluid stirring through said heat exchanger means, while maintaining a minimum of fluid flow passing behind the tines of said fluid stirring means in a direction opposite to the direction of movement thereof as the tines are moved through said heat exchanger means, said heat exchanger means further having a clear path therethrough disposed parallel to the axis and spaced-apart therefrom for permitting the fluid to pass through said heat exchanger means substantially unimpeded thereby;

c. means for rotating said fluid stirring means in said heat exchanger means so that the tines pass through said heat exchanger means; and d. means for moving the fluid under pressure into the clear path of said heat exchanger means.

4. An in-line fluid cooling apparatus, which comprises in combination:

a. fluid stirring means for stirring the fluid in the direction of motion thereof comprising an elongated support member having a plurality of tines each having a chosen width and extent and disposed in a substantially perpendicular manner to the long dimension of said support member and lying substantially in the flat plane thereof;

b. generally cylindrical heat exchanger means for exchanging heat with the fluid, said heat exchanger means having an elongated slot within the body thereof disposed along the axis thereof in which is disposed said support member and for permitting said support member to rotate therein, and having fins disposed substantially radially and perpendicular to the slot adapted to receive the tines, said fins having an extent in the direction of motion of said tines which is at least twice that of the tines, wherein the clearance between the fins and the tines provides sufficient space to permit the passage of the tines of said fluid stirring means through said heat exchanger means, while maintaining a minimum of fluid flow passing behind the tines of said fluid stirring means in a direction opposite to the direction of movement thereof as the tines are moved through said heat exchanger means, said cylindrical heat exchanger means further having a substantially planar, radially disposed entrance face and a substantially planar, radially disposed exit face where the tines of said stirring means enter and leave said cylindrical heat exchanger means, respectively;

c. means for rotating said fluid stirring means in said heat exchanger;

d. fluid containment means forming a volume with the entrance and exit face of said heat exchanger means wherein the fluid can flow past said heat exchanger means, said fluid containment means having an entrance and an exit disposed generally in-line with the volume for permitting the fluid to enter and exit said heat exchanger, respectively; and e. means for moving the fluid under pressure into the volume.

5. An apparatus for cooling laser gases, which comprises in combination:

a. fluid stirring means for stirring the fluid in the direction of motion thereof comprising a first substantially planar, elongated support member having a plurality of first tines disposed in a substantially perpendicular manner to the long dimension of said first support member and lying substantially in the plane thereof and a second substantially planar, elongated support member having a plurality of second tines disposed in a substantially perpendicular manner to the long dimension of said second support member and lying substantially in the plane thereof, said first support member being disposed parallel to and diametrically opposed to said second support member at opposite ends of the diameter of a first cylinder formed by the direction of travel of said first support member and said second support member, and wherein the tines of said first support member and the tines of said second support member are directed substantially radially to the axis of the first cylinder;

b. heat exchanger means for exchanging heat with the fluid, said heat exchanger comprising a first heat exchanger section having a substantially partially cylindrical shaped side adapted to give clearance to said first support member and said second support member with first fins disposed substantially perpendicular to the surface of the cylindrical side adapted to alternately receive the tines of said first support member and said second support member, wherein the clearance between the first fins and the first and second tines provides sufficient space to permit the passage of the first and second tines through the first fins, while, maintaining a minimum of fluid flow passing behind the first and second tines opposite to the direction of movement thereof, and a second heat exchanger section having a substantially partially cylindrical shaped side adapted to give clearance to said first support member and said second support member with second fins disposed substantially perpendicular to the surface of the cylindrical side adapted to alternately receive the tines of said first support member and said second support member, said first and second fins having an extent in the direction of motion of said first and second tines which is at least twice that of the first and second tines, wherein the clearance between the first and second fins and the first and second tines provides sufficient space to permit the passage of the first and second tines through first and second the first and second fins, while maintaining low fluid flow passing behind the first and second tines opposite to the direction of movement thereof, said first heat exchanger section being disposed diametrically opposed to said second heat exchanger section at opposite ends of the diameter of a second cyliner, colinear with the first cylinder, and with the cylindrical side of said first heat exchanger section and the partially cylindrical side of said second heat exchanger section disposed perpendicular to the diameter of the second cylinder and forming the surface thereof;

c. first baffle means disposed substantially perpendicular to the cylindrical surface of said first heat exchanger section and spaced-apart therefrom for reducing the fluid flow passing alternately behind said first support means and said second support means in a direction opposite to the direction of movement thereof, and second baffle means disposed substantially perpendicular to the cylindrical surface of said second heat exchanger section and spaced-apart therefrom for reducing the fluid flow passing alternately behind said first support means and said second support means in a direction opposite to the direction of movement thereof, and second baffle means; and d. means for moving the first and second tines of said fluid stirring means through said heat exchanger means.

* * * * *